United States Patent [19]

Dillon

[11] Patent Number: 5,029,738

[45] Date of Patent: Jul. 9, 1991

[54] DISPENSING TUBE AND FLEXIBLE SPOUT CONSTRUCTION

[76] Inventor: Michael S. Dillon, 35 RobinHood Dr., Taylors, S.C. 29687

[21] Appl. No.: 470,262

[22] Filed: Jan. 25, 1990

[51] Int. Cl.[5] ..... B67D 5/06

[52] U.S. Cl. ..... 222/527; 222/567; 222/215; 222/326; 222/565

[58] Field of Search ..... 222/527, 215, 214, 545, 222/565, 567, 325, 326, 327, 386; 239/588

[56] References Cited

U.S. PATENT DOCUMENTS

| | | | |
|---|---|---|---|
| 1,733,079 | 5/1928 | Graves et al. | 222/527 |
| 2,544,120 | 1/1948 | Wolfe | 239/588 |
| 2,831,615 | 4/1958 | Sherbondy | 222/391 |
| 2,953,285 | 8/1958 | McKelvey | 222/567 |
| 3,058,632 | 10/1962 | Stremmel | 222/567 |
| 3,402,741 | 9/1968 | Yurdin | 222/527 X |
| 3,415,675 | 12/1968 | Allen | 222/527 X |
| 3,439,839 | 9/1965 | Schumann et al. | 222/327 |
| 3,884,231 | 5/1975 | Peters | 222/566 X |
| 4,801,008 | 1/1989 | Rich | 222/137 X |

*Primary Examiner*—Andres Kashnikow
*Assistant Examiner*—Lesley D. Morris
*Attorney, Agent, or Firm*—Leon Gilden

[57] ABSTRACT

An apparatus including an elongate dispensing tube and a forward conical dispensing tip is provided, wherein the dispensing tip includes a deformable dispensing portion formed to enable displacement and repositioning of the dispensing tip during use of the apparatus. A modification of the instant invention includes a bellowed dispensing tube body, as well as inclusion of dispensing caps threadedly mounted to a forward end of the dispensing tip to provide various flow characteristics therethrough. The dispensing tip includes reinforcing wires mounted therein to maintain a displaced configuration of the dispensing tip.

1 Claim, 4 Drawing Sheets

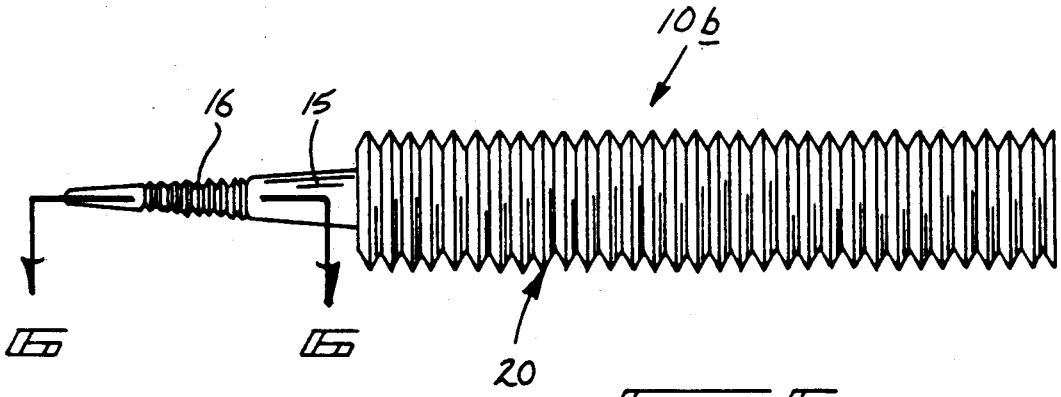
FIG 5
FIG 6
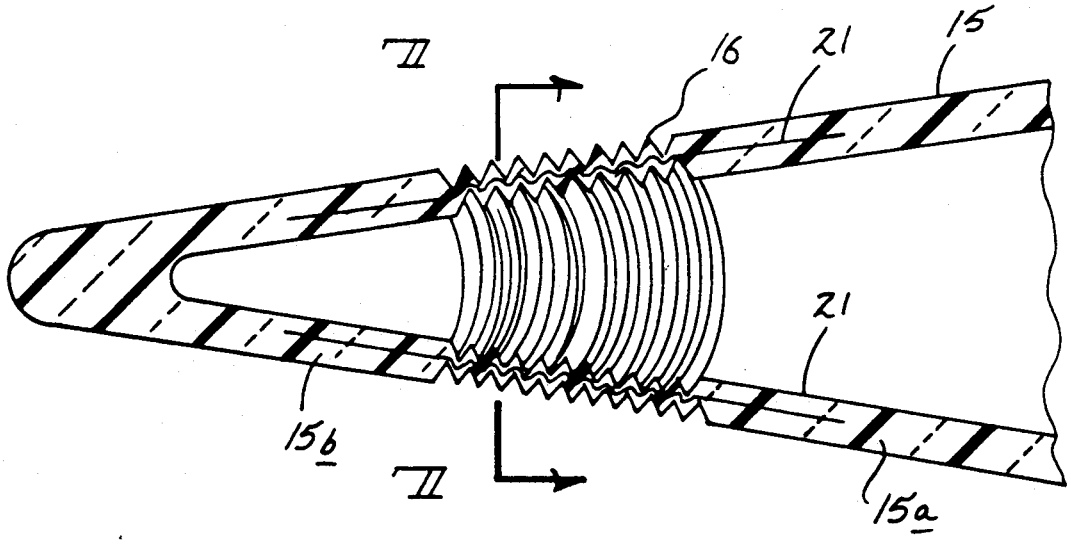

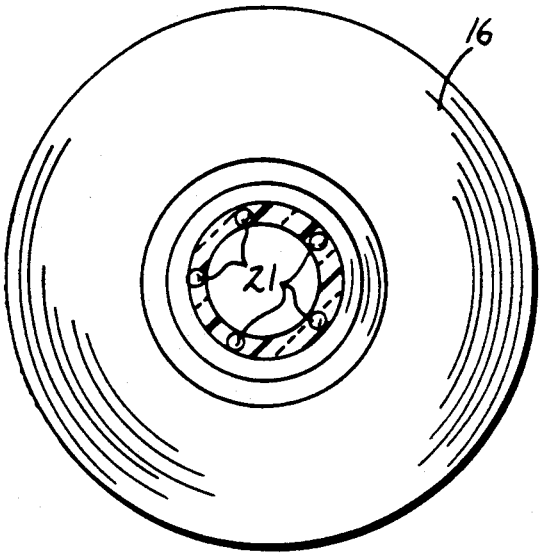
FIG 7
FIG 8
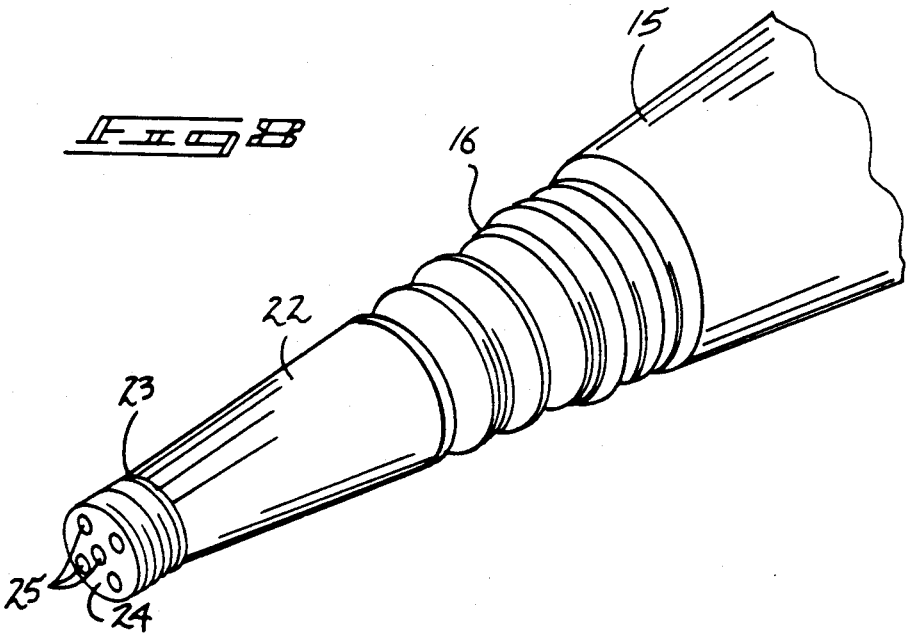

DISPENSING TUBE AND FLEXIBLE SPOUT CONSTRUCTION

BACKGROUND OF THE INVENTION

1. Field of the Invention

The field of invention relates to dispensing tube structures, and more particularly pertains to a new and improved dispensing tube and flexible spout construction wherein the same enables angular displacement of a forwardly positioned dispensing tip to enable enhanced access to remove portions in the application of caulk, glue, and the like contained within the organization.

2. Description of the Prior Art

Various compounds are marketed and dispensed through the use of elongate, generally cylindrical cartridges formed with a forwardly oriented dispensing tip. The tips are generally of a rigid configuration and are arranged with a displacement piston mounted interiorly of the elongate body at a rearwardmost end thereof, wherein positioning within a "caulking-type gun" enables displacement of the compounds and materials in a generally plastic-like form contained within the body. There are available various constructions for use in dispensing materials where an example may be found in Rich U.S. Pat. No. 4,801,008 wherein a disposable elongate cartridge body contains an internally displaceable piston therewithin including a forward rigid nozzle provided with a static mixing element to prevent clogging within the nozzle.

Peters U.S. Pat. No. 3,884,231 sets forth a syringe member wherein the elongate body includes a bellows type joint at the junction of the body and the forward tip to enable manual pivotment of the tip during use of the invention.

Yurdin U.S. Pat. No. 3,402,741 sets forth the use of a conduit manually displaceable for use in discharge of fluids therethrough.

Allen U.S. Pat. No. 3,415,675 sets forth a liquid application organization wherein the nozzle construction is of a deformable, elongate cylindrical configuration to enable directing of fluid contained within the container of the organization to various portions of a surface.

Sherbondy U.S. Pat. No. 2,831,615 illustrates the use of a conventional caulking gun and cartridge therewith for displacement of compounds therefrom.

As such, it may be appreciated that there is a continuing need for a new and improved dispensing tube and flexible spout construction wherein the spout includes a deformable bellows joint positioned generally medially of the nozzle to enable the directing of compounds therethrough.

SUMMARY OF THE INVENTION

In view of the foregoing disadvantages inherent in the known types of dispensing tubes now present in the prior art, the present invention provides a dispensing tube and flexible spout construction wherein the same utilizes a flexible bellows joint mounted medially of a dispensing tip to enable the directing of various compounds therethrough at selective angles relative to an associated container body. As such, the general purpose of the present invention, which will be described subsequently in greater detail, is to provide a new and improved dispensing tube and flexible spout construction which has all the advantages of the prior art dispensing tubes and none of the disadvantages.

To attain this, the present invention provides an apparatus including an elongate dispensing tube and a forward conical dispensing tip, wherein the dispensing tip includes a deformable dispensing portion formed to enable displacement and repositioning of the dispensing tip during use of the apparatus. A modification of the instant invention includes a bellowed dispensing tube body, as well as inclusion of dispensing caps threadedly mounted to a forward end of the dispensing tip to provide various flow characteristics therethrough. The dispensing tip includes reinforcing wires mounted therein to maintain a displaced configuration of the dispensing tip.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved dispensing tube and flexible spout construction which has all the advantages of the prior art dispensing tubes and none of the disadvantages.

It is another object of the present invention to provide a new and improved dispensing tube and flexible spout construction which may be easily and efficiently manufactured and marketed.

It is a further object of the present invention to provide a new and improved dispensing tube and flexible spout construction which is of a durable and reliable construction.

An even further object of the present invention is to provide a new and improved dispensing tube and flexible spout construction which is susceptible of a low cost of manufacture with regard to both materials and labor, and which accordingly is then susceptible of low prices of sale to the consuming public, thereby making such dispensing tubes and flexible spout constructions economically available to the buying public.

Still yet another object of the present invention is to provide a new and improved dispensing tube and flexible spout construction which provides in the apparatuses and methods of the prior art some of the advantages thereof, while simultaneously overcoming some of the disadvantages normally associated therewith.

Still another object of the present invention is to provide a new and improved dispensing tube and flexible spout construction wherein the same enables manual displacement and repositioning of a forwardly mounted conical dispensing tip with the connection mounted forward of the tubular body to enable access of the tip within discrete and remote positions spaced from the elongate body.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is an orthographic side view taken in elevation of a further modification of the instant invention.

FIG. 6 is an orthographic view taken along the lines 6—6 of FIG. 5 in the direction indicated by the arrows.

FIG. 7 is an orthographic view taken along the lines 7—7 of FIG. 6 in the direction indicated by the arrows.

FIG. 8 is an isometric illustration of a further modified tip utilized by the instant invention.

DESCRIPTION OF THE PREFERRED EMBODIMENT

Figure 1:
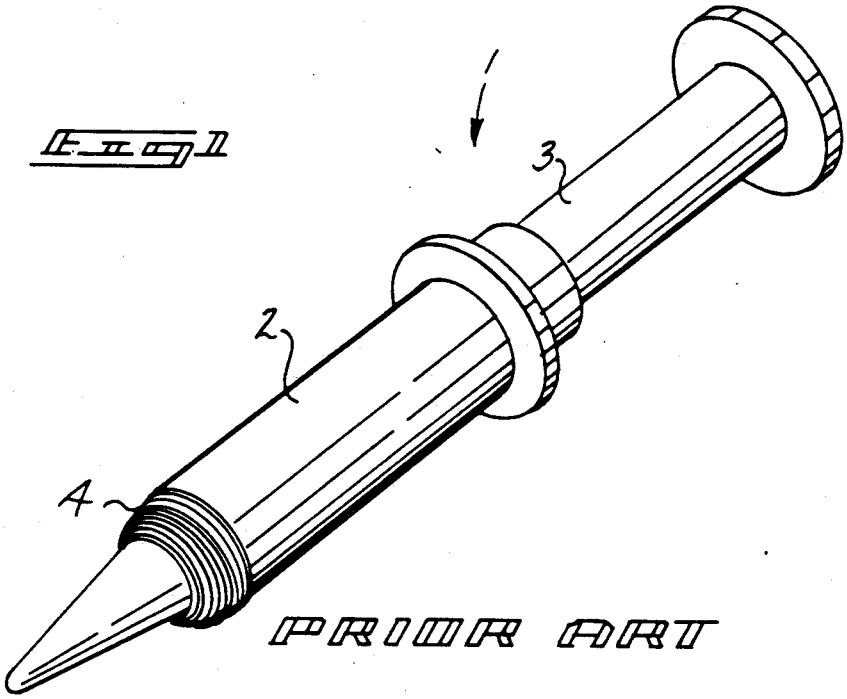
Fig 1 PRIOR ART
FIG. 1 is an isometric illustration of a prior art dispensing tube construction.
Figure 2:
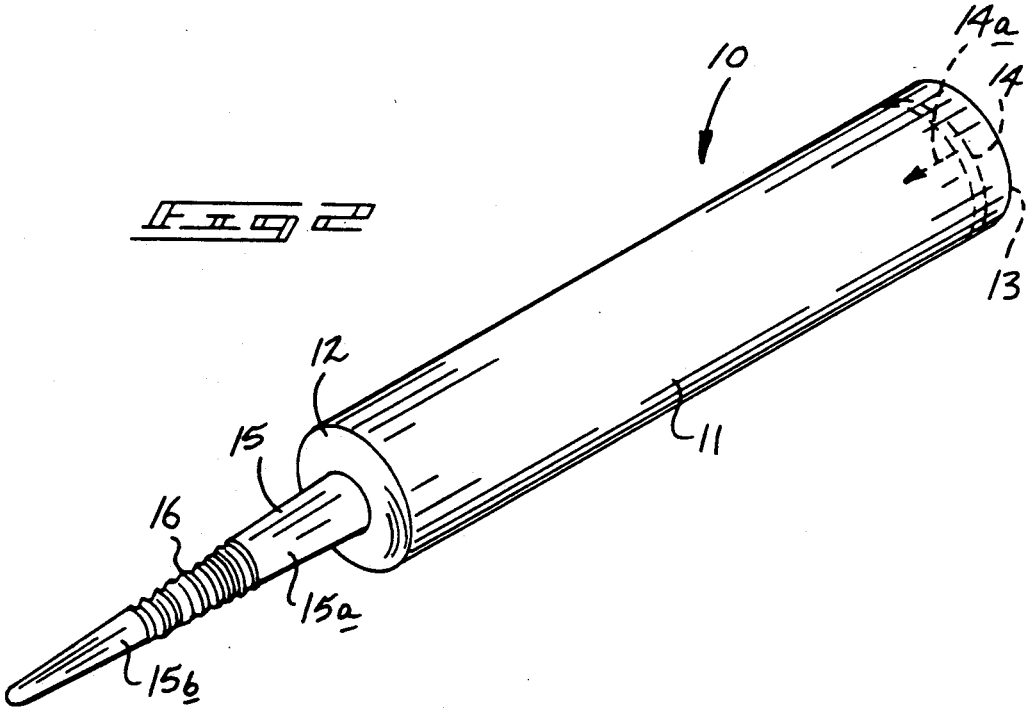
FIG. 2 is an isometric illustration of the instant invention.

With reference now to the drawings, and in particular to FIGS. 1 to 8 thereof, a new and improved dispensing tube and flexible spout construction embodying the principles and concepts of the present invention and generally designated by the reference numerals 10, **10*a*, and 10*b*** will be described.

FIG. 1 is illustrative of a prior dispensing tube 1 comprising an elongate cylindrical body 2 and a rearwardly extending plunger 3. A forward tip includes a pleated or bellowed body junction 4 mounting the body to the forward conical dispensing tip.

Figure 3:
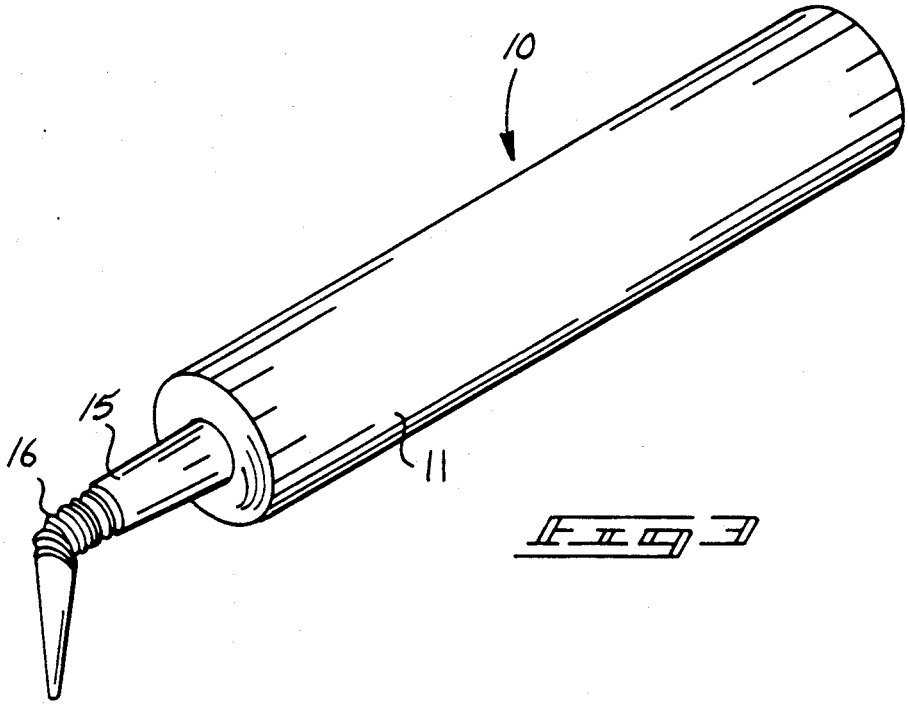
FIG. 3 is an isometric illustration of the instant invention illustrating the nozzle in a displaced orientation relative to the tubular body.
Figure 4:
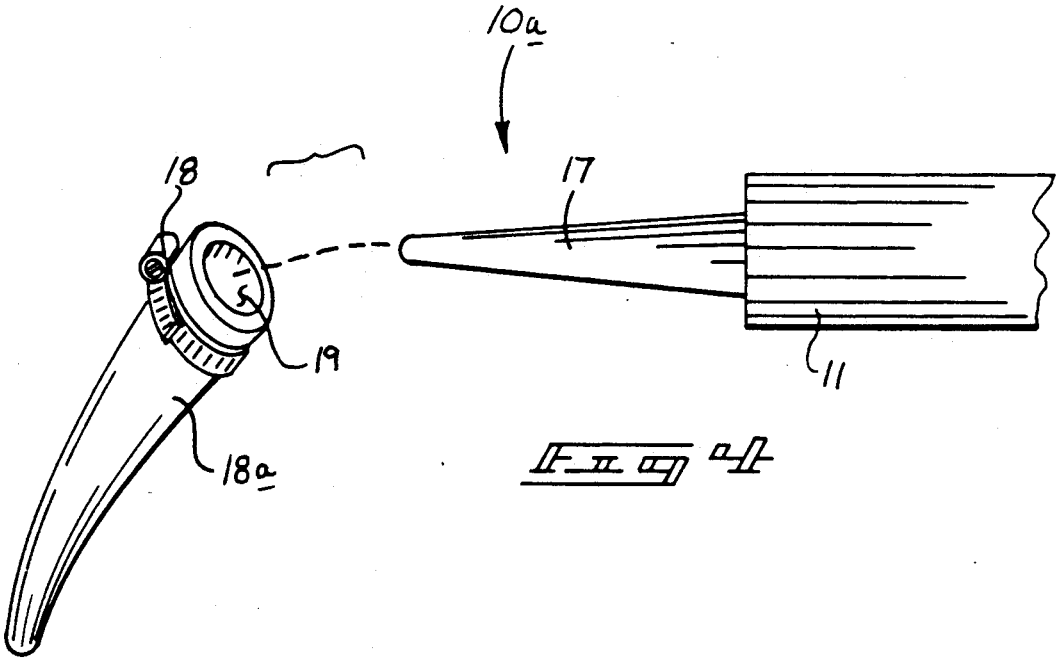
FIG. 4 is an isometric partial view illustrating a modified tip of the instant invention in association with a dispensing cartridge.

More specifically, the dispensing tube and flexible spout construction 10 of the instant invention essentially comprises a central tubular body 11 formed with a planar forward end surface 12 and a coaxially aligned rear end opening 13. A displaceable piston cup 14 is mounted interiorly of the tubular body 11 and is accessible through the rear end opening 13 by a conventional caulking type gun (not shown) in the direction of the arrow **14*a*. A forward, conical dispensing tip 15 is formed with a conical rear tip portion 15*a* and a conical forward tip portion 15*b* with a medially position pleated bellows connection 16 joining the rear and forward tip portions 15*a* and 15*b* together. The connection 16 is of a shape retaining construction to maintain a displaced shape, as illustrated in FIG. 3** for example.

Alternatively, a modification of the instant invention includes a solid conical dispensing tip 17 mounted coaxially and forwardly of the elongate body 11. A deformable conical tip member 18 is provided with a rear tip opening 19 of a complementary configuration to that defined by the dispensing tip 17, with a clamp **18*a* mounted adjacent the tip opening 19 to secure the solid tip 17 to the deformable tip 18. The deformable tip 18 is formed of a shape retaining polymeric to enable maintaining of a displaced configuration imparted to the tip 18** by a individual.

FIG. 5 illustrates a further modified organization **10*b* utilizing an elongate compressible body 20, including a bellows construction of a constant diameter throughout. In this manner, the entire body is compressible to enable displacement of a compound therefrom upon axial compression of the bellows body 20. The forward conical tip 15 includes the pleated bellows medial connection 16. FIG. 6 illustrates details of the connection 16 utilizing an equally spaced matrix of surrounding deformable stiffening wires 21 mounted within the polymeric body of the tip 15 directed from the rear portion 15*a* to the forward portion 15*b* and through the connection 16, as illustrated in FIG. 6. As illustrated, the forward tip portion 15*b*** is constructed of a solid forward end where it is conventionally understood that the solid portion is merely cut off prior to use of the dispensing tube and spout construction.

FIG. 7 illustrates the spaced matrix of at least five of the stiffening wires utilized throughout the tip.

FIG. 8 illustrates the tip 15 formed with a modified conical tip portion 22. A threaded forward tip surface 23 is provided to selectively receive various internally threaded replaceable dispensing cap members illustrated as a member 24 formed with a matrix of apertures 25 therethrough to provide desired flow characteristics of compound contained within the body 11, or 20.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A dispensing tube and flexible spout apparatus comprising in combination, an elongate generally cylindrical tubular body means for storage and subsequent displacement therefrom of a preselected compound, and the tubular body means including a solid forward end wall arranged generally orthogonally to an access of the tubular body means, and an elongate conical dispensing tip coaxially and orthogonally mounted to the forward end wall, and the dispensing tip including a deformable member spaced from the forward end wall, wherein the elongate dispensing tip includes a rigid rear tip portion adjacent the forward end wall to provide access to remote compound application positions, and wherein the deformable member includes a pleated elongate bellows connection between the rigid rear tip portion defined as a truncated conical configuration, and a rigid forward conical tip portion to displaceably mounted the forward tip portion to the rear tip portion, the bellows connection of a shape retaining construction to maintain a displaced configuration imparted thereto, and wherein the dispensing tip includes a matrix of deformable, shape retaining stiffening wires imbedded within the tip portion, the bellows connection and the forward portion joining the rear tip portion, the bellows connection, and the forward tip portions together, the stiffening wires equally spaced throughout the dispensing tip to define a conical surface of revolution, and wherein the forward tip portion includes an externally threaded forward end, and internally threaded cap member threadedly receivable in the forward threaded end, the cap member including a plurality of apertures therethrough to alter flow characteristics through the cap member.

* * * * *